US010833487B2

(12) United States Patent
Kawata et al.

(10) Patent No.: US 10,833,487 B2
(45) Date of Patent: Nov. 10, 2020

(54) IGNITION APPARATUS FOR INTERNAL COMBUSTION ENGINE

(71) Applicant: DENSO CORPORATION, Kariya (JP)

(72) Inventors: Yuuki Kawata, Nisshin (JP); Daisuke Tanaka, Nisshin (JP); Daisuke Shimamoto, Kariya (JP); Naoto Hayashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/454,510

(22) Filed: Jun. 27, 2019

(65) Prior Publication Data

US 2020/0006926 A1 Jan. 2, 2020

(30) Foreign Application Priority Data

Jun. 29, 2018 (JP) ..... 2018-124165

(51) Int. Cl.
*H01T 13/34* (2006.01)
*H01T 13/08* (2006.01)

(52) U.S. Cl.
CPC ..... *H01T 13/34* (2013.01); *H01T 13/08* (2013.01)

(58) Field of Classification Search
CPC ..... H01T 13/34; H01T 13/08; H01T 13/14; H01T 13/32
See application file for complete search history.

(56) References Cited

U.S. PATENT DOCUMENTS 3,449,613 A * 6/1969 Francesco ..... H01T 13/39 313/136
3,509,403 A * 4/1970 Krow ..... H01T 13/14 313/121
3,537,160 A * 11/1970 Francesco ..... H01T 13/39 445/7
4,406,968 A * 9/1983 Friese ..... H01T 21/02 313/136
4,810,929 A * 3/1989 Strumbos ..... H01T 13/16 313/11.5

(Continued)

FOREIGN PATENT DOCUMENTS

JP S62-045926 2/1987
JP H05-326107 12/1993

(Continued)

*Primary Examiner* — Joseph J Dallo
(74) *Attorney, Agent, or Firm* — Nixon & Vanderhye P.C.

(57) ABSTRACT

An ignition apparatus for an internal combustion engine includes a center electrode, a ground electrode, an insulator, a housing, and an insulator protective wall portion. The ground electrode is disposed such that a discharge gap is formed between the ground electrode and the center electrode. The insulator holds the center electrode on an inner side of the insulator. The housing holds the insulator on an inner side of the housing. The insulator protective wall portion is arranged to surround an outer circumference side of a distal end portion of the insulator. A distal end of the insulator protective wall portion is positioned further towards a distal end side than a distal end of the insulator is and further towards a proximal end side than a distal end of the center electrode is. The insulator protective wall portion includes an inward protruding portion that protrudes towards a side surface of the center electrode.

10 Claims, 9 Drawing Sheets

(56) References Cited

U.S. PATENT DOCUMENTS

| | | | | |
|---|---|---|---|---|
| 4,987,868 | A * | 1/1991 | Richardson | H01T 13/08 123/260 |
| 2007/0204813 | A1* | 9/2007 | Arai | F02M 25/028 123/25 A |
| 2009/0194053 | A1* | 8/2009 | Nakamura | H01T 13/32 123/143 B |
| 2012/0299458 | A1* | 11/2012 | Aochi | H01T 13/32 313/120 |
| 2014/0137845 | A1* | 5/2014 | Achtstatter | H01T 13/44 123/634 |
| 2016/0215710 | A1* | 7/2016 | Berkemeier | F02D 37/02 |
| 2017/0025824 | A1* | 1/2017 | Mixell | H01T 21/02 |
| 2019/0148920 | A1* | 5/2019 | Shen | H01T 13/34 315/58 |

FOREIGN PATENT DOCUMENTS

| | | |
|---|---|---|
| JP | 3023217 | 4/1996 |
| JP | H09-139276 | 5/1997 |
| JP | 2003-239809 | 8/2003 |
| JP | 2005-127324 | 5/2005 |
| JP | 2005-315144 | 11/2005 |
| JP | 2006-009701 | 1/2006 |
| JP | 2007-113461 | 5/2007 |

* cited by examiner

IGNITION APPARATUS FOR INTERNAL COMBUSTION ENGINE

CROSS-REFERENCE TO RELATED APPLICATION

This application is based on and claims the benefit of priority from Japanese Patent Application No. 2018-124165, filed Jun. 29, 2018. The entire disclosure of the above application is incorporated herein by reference.

BACKGROUND

Technical Field

The present disclosure relates to an ignition apparatus for an internal combustion engine.

Related Art

An ignition apparatus for an internal combustion engine ignites an air-fuel mixture present inside a combustion chamber using a spark plug that is mounted in the internal combustion engine. For example, in a direct-injection-type internal combustion engine, fuel that is sprayed from a fuel injection valve is mixed with air in the combustion chamber. The air-fuel mixture is then ignited. Here, preventing fuel spray from attaching to an insulator of the spark plug is desired.

SUMMARY

The present disclosure provides an injection apparatus for an internal combustion engine. The injection apparatus includes: a center electrode; a ground electrode; an insulator that holds the center electrode; a housing that holds the insulator; and an insulator protective wall portion that surrounds an outer circumferential side of a distal end portion of the insulator. A distal end of the insulator protective wall portion is positioned further towards a distal end side than a distal end of the insulator is and further towards a proximal end side than a distal end of the center electrode is. The insulator protective wall portion includes an inward protruding portion that protrudes towards a side surface of the center electrode.

DESCRIPTION OF THE EMBODIMENTS

Figure 1:
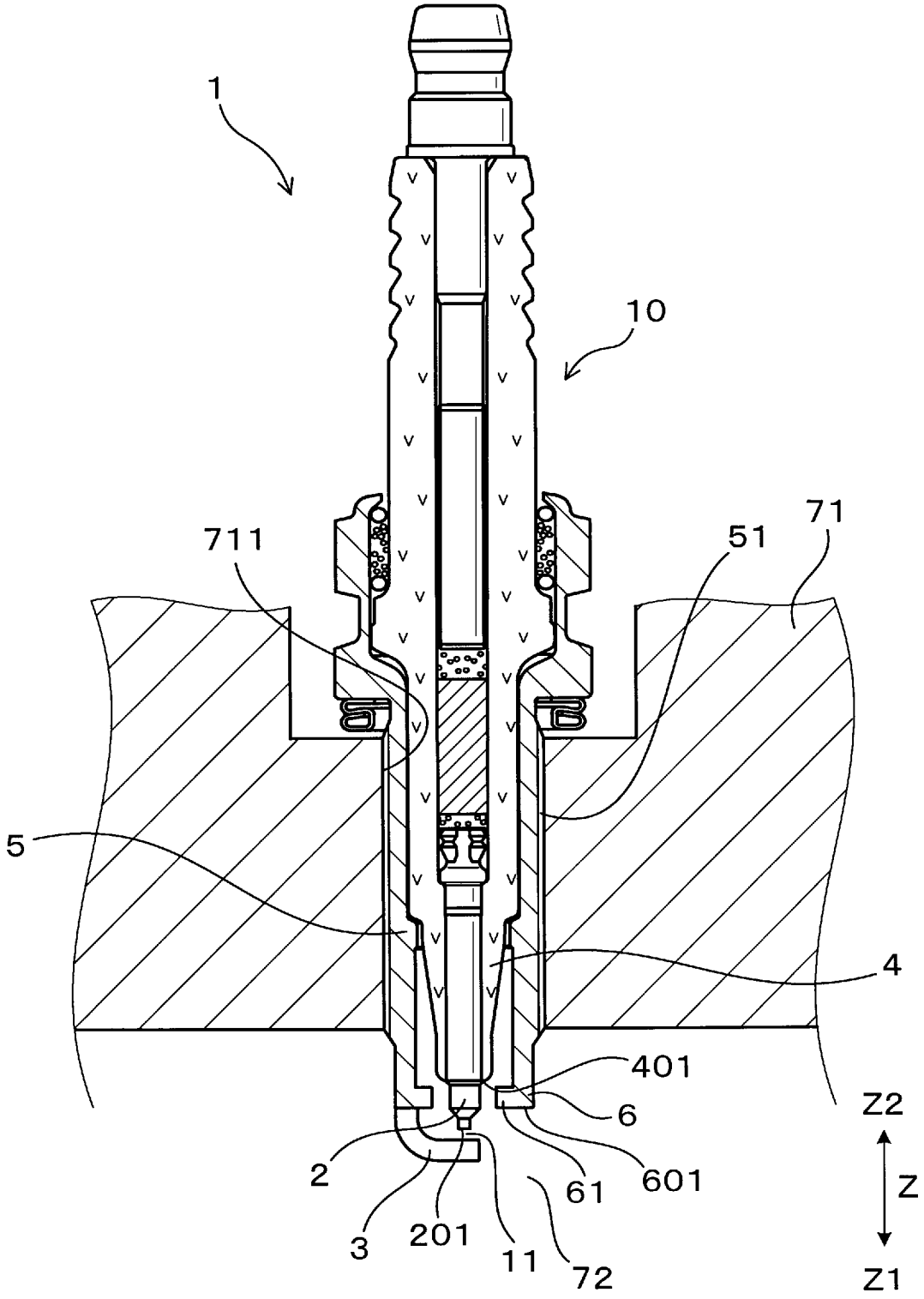
FIG. 1 is a cross-sectional view of an ignition apparatus according to a first embodiment.

In related art, a ground electrode is configured to be mounted in the combustion chamber as a separate component from a main body of the spark plug, such that the ground electrode can be arranged in a predetermined position inside the combustion chamber. As a result, the ground electrode is prevented from changing the orientation of the fuel spray. Fuel is prevented from attaching to the insulator.

However, even if arranging the ground electrode in a predetermined position is possible, preventing the fuel from attaching to the insulator is not necessarily easy.

That is, for example, the sprayed fuel reaching the insulator as a result of being carried by air flow or the like inside the combustion chamber can also be considered. In this case, as a result of the fuel attached to the insulator being burned, soot attaches to a surface of the insulator. In addition, even if liquid fuel is not attached to the insulator, soot that is produced by unevaporated fuel being burned near the insulator may attach to the surface of the insulator. When soot attaches to the surface of the insulator in this manner, obstruction of appropriate spark discharge at a discharge gap, that is, occurrence of so-called smoldering becomes a concern.

It is thus desired to provide an ignition apparatus for an internal combustion engine that suppresses the occurrence of smoldering.

An exemplary embodiment of the present disclosure provides an injection apparatus for an internal combustion engine, including a center electrode, a ground electrode, an insulator, a housing, and an insulator protective wall portion. The ground electrode is disposed such that a discharge gap is provided between the ground electrode and the center electrode. The insulator holds the center electrode on an inner side of the insulator. The housing holds the insulator on an inner side of the housing. The insulator protective wall portion is arranged to surround an outer circumferential side of a distal end portion of the insulator. A distal end of the insulator protective wall portion is positioned further towards a distal end side than a distal end of the insulator is and further towards a proximal end side than a distal end of the center electrode is. The insulator protective wall portion includes an inward protruding portion that protrudes towards a side surface of the center electrode.

The above-described ignition apparatus includes the insulator protective wall portion that is configured as described above. In addition, the insulator protective wall portion includes the inward protruding portion that protrudes towards the side surface of the center electrode. As a result, fuel can be prevented from attaching to the insulator. Soot can also be prevented from attaching to the insulator. That is, the insulator protective wall portion can prevent fuel or soot that is blown radially inward from reaching a surface of the insulator or the periphery of the insulator. In addition, the inward protruding portion can prevent fuel or soot from infiltrating the inner side of the housing from the distal end side in an axial direction. As a result, soot attributed to fuel attaching to a surface of the insulator can be suppressed. Consequently, the occurrence of smoldering can be suppressed.

As described above, according to the above-described exemplary embodiment, an ignition apparatus for an internal combustion engine that suppresses the occurrence of smoldering can be provided.

First Embodiment

An ignition apparatus for an internal combustion engine according to a first embodiment will be described with reference to FIG. 1 to FIG. 4.

Figure 2:
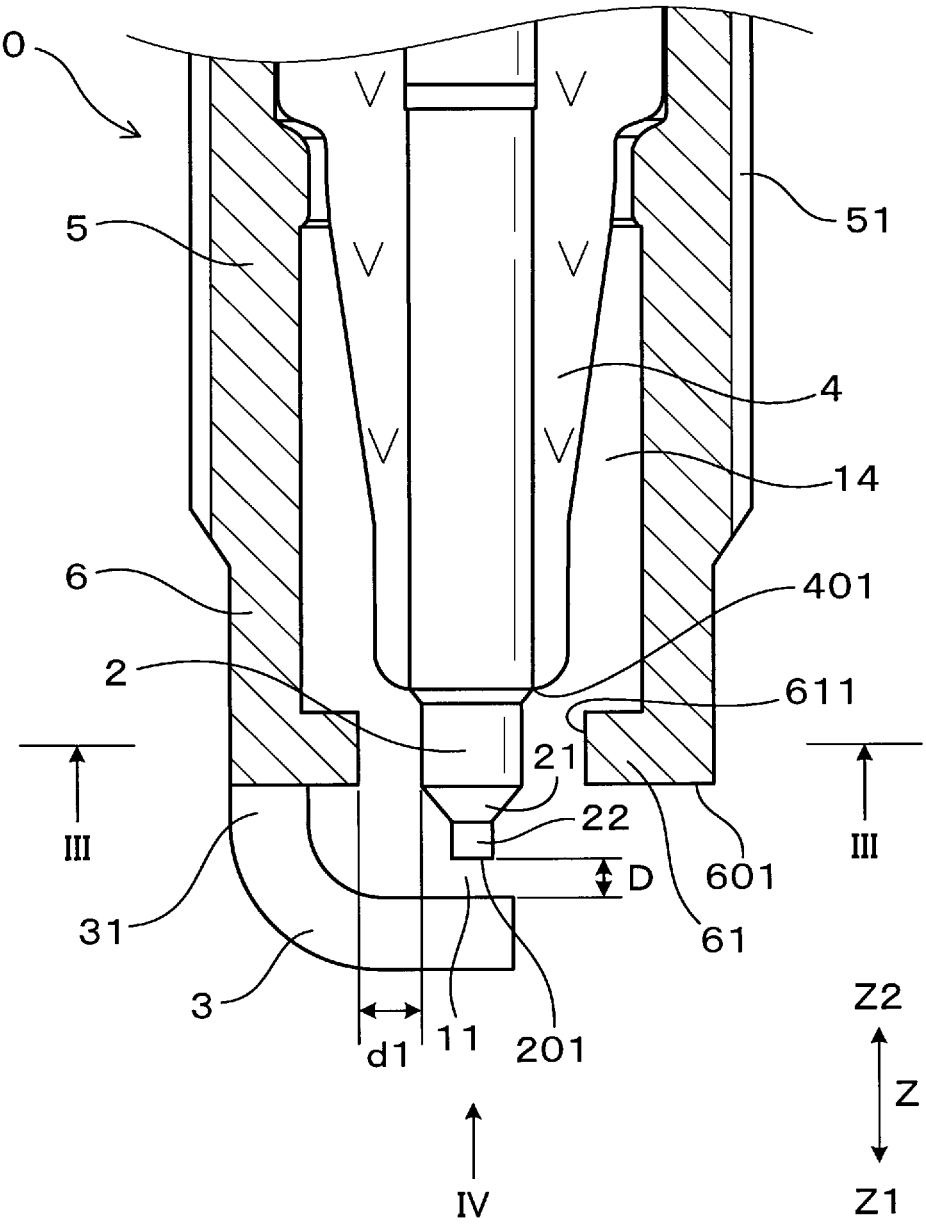
FIG. 2 is a cross-sectional view of a portion of a spark plug on a distal end side according to the first embodiment.

As shown in FIG. 1 and FIG. 2, an ignition apparatus 1 according to the present embodiment includes a center electrode 2, a ground electrode 3, an insulator 4, a housing 5, and an insulator protective wall portion 6. The ground electrode 3 is disposed such that a discharge gap 11 is provided between the ground electrode 3 and the center electrode 2. The insulator 4 has a cylindrical shape and holds the center electrode 2 on an inner side of the insulator 4. The housing 5 has a cylindrical shape and holds the insulator 4 on an inner side of the housing 5. The insulator protective wall portion 6 is arranged to surround an outer circumferential side of a distal end portion of the insulator 4.

A distal end 601 of the insulator protective wall portion 6 is positioned further towards a distal end side Z1 than a distal end 401 of the insulator 4 is and further towards a proximal end side Z2 than a distal end 201 of the center electrode 2 is.

The insulator protective wall portion 6 has an inward protruding portion 61 that protrudes towards a side surface of the center electrode 2.

For example, the ignition apparatus 1 can be used as an igniting means in an internal combustion engine for a vehicle such as an automobile. The ignition apparatus 1 is configured such that a spark plug 10 is fixed to a cylinder head 71. According to the present embodiment, the spark plug 10 includes the center electrode 2, the ground electrode 3, the insulator 4, the housing 5, and the insulator protective wall portion 6. In addition, the spark plug 10 is mounted to the internal combustion engine by an attachment screw portion 51 that is formed in an outer circumference of the housing 5 being screwed into a plug hole 711 in the cylinder head 71.

In the present specification, a side on which the spark plug 10 is inserted into a combustion chamber 72 in an axial direction Z of the spark plug 10 is a distal end side (tip end side) Z1. A side opposite the distal end side Z1 is a proximal end side (base end side) Z2.

The insulator protective wall portion 6 is formed in a distal end portion of the housing 5. That is, the distal end portion of the housing 5 is extended towards the distal end side Z1 and thereby configures the insulator protective wall portion 6. The insulator protective wall portion 6 protrudes towards the combustion chamber 72.

As shown in FIG. 2, the insulator protective wall portion 6 has the inward protruding portion 61 in a distal end portion of the insulator protective wall portion 6. The inward protruding portion 61 is configured such that an overall inner-side end surface 611 is present further towards the distal end side Z1 than the distal end 401 of the insulator 4 is. In addition, the overall inner-side end surface 611 of the inward protruding portion 61 opposes the side surface of the center electrode 2. The inner-side end surface 611 is approximately parallel to the axial direction Z.

Figure 3:
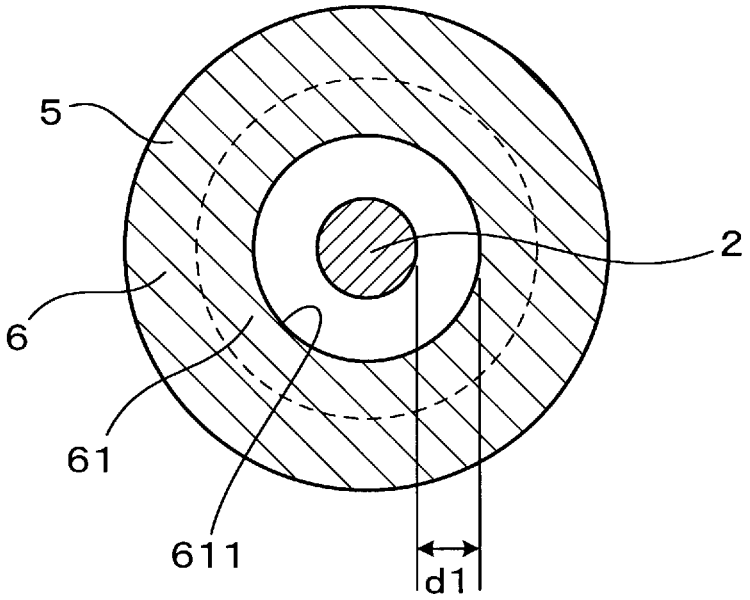
FIG. 3 is a cross-sectional view taken along line III-III in FIG. 2.

As shown in FIG. 3, the inward protruding portion 61 is formed to surround the outer circumference of the center electrode 2. As shown in FIG. 3, in terms of a cross-sectional shape at a cross-section taken on a plane that is perpendicular to the axial direction Z and passes through the center electrode 2 and the inward protruding portion 61, an outer circumferential surface of the center electrode 2 and the inner-side end surface 611 of the inward protruding portion 61 are formed into approximately concentric circles. Therefore, a distance d1 between the center electrode 2 and the inward protruding portion 61 is approximately equal at any position in the circumferential direction.

Figure 4:
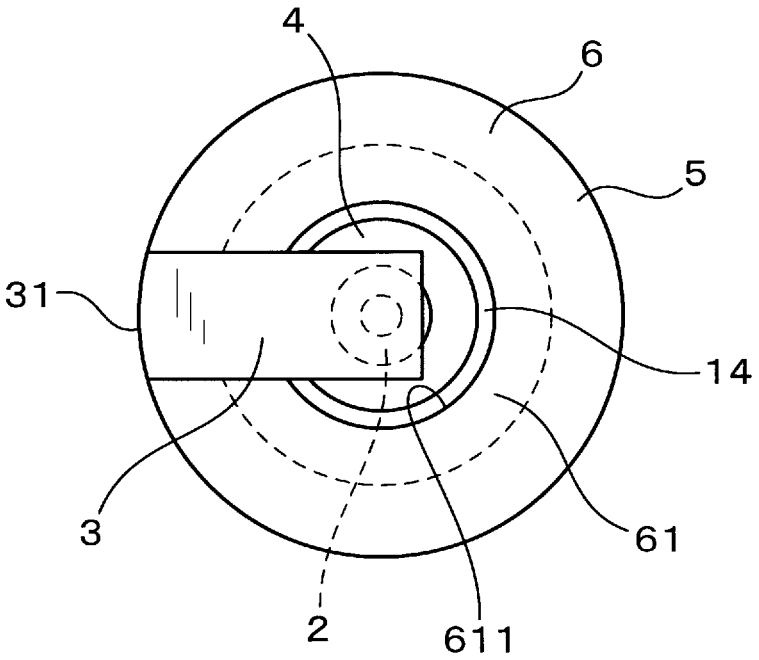
FIG. 4 is a plan view viewed from arrow IV in FIG. 2.

As shown in FIG. 1, FIG. 2, and FIG. 4, the ground electrode 3 is fixed to the housing 5. That is, a fixed end 31 of the ground electrode 3 is fixed to a distal end portion of the insulator protective wall portion 6 that is formed in the distal end portion of the housing 5. As shown in FIG. 2, the ground electrode 3 extends from the housing 5 towards the distal end side Z1 and bends towards a center axis side of the spark plug 10. In addition, the periphery of an end portion on the side opposite the fixed end 31 of the ground electrode 3 opposes the center electrode 2 in the axial direction Z. As a result, the discharge gap 11 is formed between the center electrode 2 and the ground electrode 3.

The inward protruding portion 61 includes metal. As shown in FIG. 2, the distance d1 between the inward protruding portion 61 and the center electrode 2 is greater than a dimension D of the discharge gap 11.

The inward protruding portion 61 is formed as a portion of the insulator protective wall portion 6. In addition, the insulator protective wall portion 6 is integrally formed with the housing 5. That is, according to the present embodiment, the inward protruding portion 61 is integrally formed with the housing 5 that includes metal. For example, the housing 5 includes a nickel alloy. In addition, the ground electrode 3 also includes a nickel alloy.

The center electrode 2 includes an electrode base material 21 and a noble metal chip 22 that is joined to a distal end of the electrode base material 21. A portion of the electrode base material 21 protrudes from the insulator 4 towards the distal end side Z1. The outer circumferential surface of the portion of the electrode base material 21 that protrudes towards the distal end side Z1 of the insulator 4 opposes the inner end surface 611 of the inward protruding portion 61 in a radial direction.

Here, according to the present embodiment, for example, the ignition apparatus 1 can be applied to a direct-injection-type internal combustion engine in which fuel is directly injected into the combustion chamber 72. That is, for example, the configuration may be such that a fuel injection valve (not shown) is disposed, together with the spark plug 10, in the cylinder head 71.

Next, working effects according to the present embodiment will be described.

The ignition apparatus 1 includes the insulator protective wall portion 6. In addition, the insulator protective wall portion 6 includes the inward protruding portion 61. As a result, fuel can be prevented from attaching to the insulator 4. Soot attaching to the insulator 4 can also be prevented. That is, the insulator protective wall portion 6 can prevent fuel or soot that is blown radially inward from reaching the surface of the insulator 4 or the periphery of the insulator 4. In addition, the inward protruding portion 6 can prevent fuel or soot from infiltrating the inner side of the housing 5 from the distal end side Z1 in the axial direction.

In this manner, infiltration of fuel or soot into a space (hereinafter referred to as a pocket portion 14, as appropriate) on the inner side of the housing 5 and the outer side of the insulator 4 can be prevented. As a result, soot attributed to fuel attaching to the surface of the insulator 4 can be suppressed. Consequently, the occurrence of smoldering can be suppressed.

In addition, the inward protruding portion 61 is formed to surround the outer circumference of the center electrode 2. As a result, infiltration of fuel or soot into the inner side of the housing 5 (that is, the pocket portion 14) from the distal end side Z1 can be further effectively suppressed.

Furthermore, the distance d1 between the inward protruding portion 61 and the center electrode 2 is greater than the dimension D of the discharge gap 11. As a result, the occurrence of discharge between the inward protruding portion 61 and the center electrode 2 can be effectively suppressed. That is, discharge in the discharge gap 11 can be made to occur reliably. As a result, ignitability of the ignition apparatus 1 can be ensured.

In addition, the insulator protective wall portion 6 is formed in the distal end portion of the housing 5. As a result, the insulator protective wall portion 6 can be easily and accurately formed. In accompaniment, manufacturing cost of the ignition apparatus 1 can be reduced.

The ground electrode 3 is fixed to the housing 5. As a result, the discharge gap 11 can be accurately formed. That is, as a result of the center electrode 2 and the ground electrode 3 being formed as a portion of the spark plug 10, during manufacturing of the spark plug 10, the discharge gap 11 can be formed into a predetermined size. As a result, the discharge gap 11 can be accurately formed and ignitability can be improved.

As described above, according to the present embodiment, an ignition apparatus for an internal combustion engine that suppresses the occurrence of smoldering can be provided.

Second Embodiment

Figure 5:
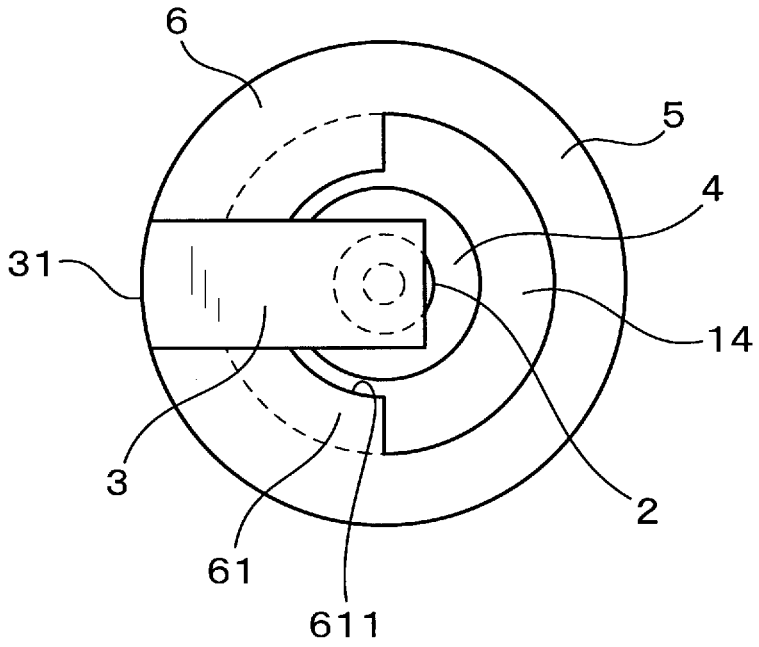
FIG. 5 is a plan view of the spark plug according to a second embodiment, viewed from the distal end side.

According to a second embodiment, as shown in FIG. 5, the inward protruding portion 61 is arranged to oppose only a portion of the outer circumference of the center electrode 2.

That is, according to the first embodiment, as shown in FIG. 3 and FIG. 4, the inward protruding portion 61 is formed to surround the outer circumference of the center electrode 2. However, according to the present embodiment, as shown in FIG. 5, the inward protruding portion 61 opposes only a portion of the outer circumference of the center electrode 2.

According to the present embodiment, the inward protruding portion 61 is formed over an angular area of about half of the overall circumference, that is, about 180 degrees. In addition, the inward protruding portion 61 is formed in an area on the fixed end 31 side of the ground electrode 3.

Other configurations are similar to those according to the first embodiment. Here, of the reference numbers that are used according to the second and subsequent embodiments, the reference numbers that are the same as those used in a previous embodiment indicate constituent elements and the like that are similar to those according to the previous embodiment, unless otherwise noted.

According to the present embodiment, ventilation of the pocket portion 14 is facilitated. That is, when high-temperature gas stagnates in the pocket portion 14, self-ignition of the air-fuel mixture in the pocket portion 14 becomes a concern. According to the present embodiment, an advantage in that such stagnation of high-temperature gas in the pocket portion 14 is easily suppressed is achieved. Therefore, if infiltration of fuel and soot into the pocket portion 14 is sufficiently preventable as a result of the partial inward protruding portion 61 being formed, in terms of the foregoing, the ignitability of the ignition apparatus 1 can be easily improved.

Other working effects are similar to those according to the first embodiment.

Here, as a variation example according to the present embodiment, the inward protruding portion 61 may be formed in an area on the side opposite the fixed end 31 of the ground electrode 3.

When the inward protruding portion 61 is formed only in a portion of the outer circumference of the center electrode 2, for example, the formation area of the inward protruding portion 61 can be set as appropriate based on a scattering direction of liquid fuel and the like within the combustion chamber 72.

Third Embodiment

Figure 6:
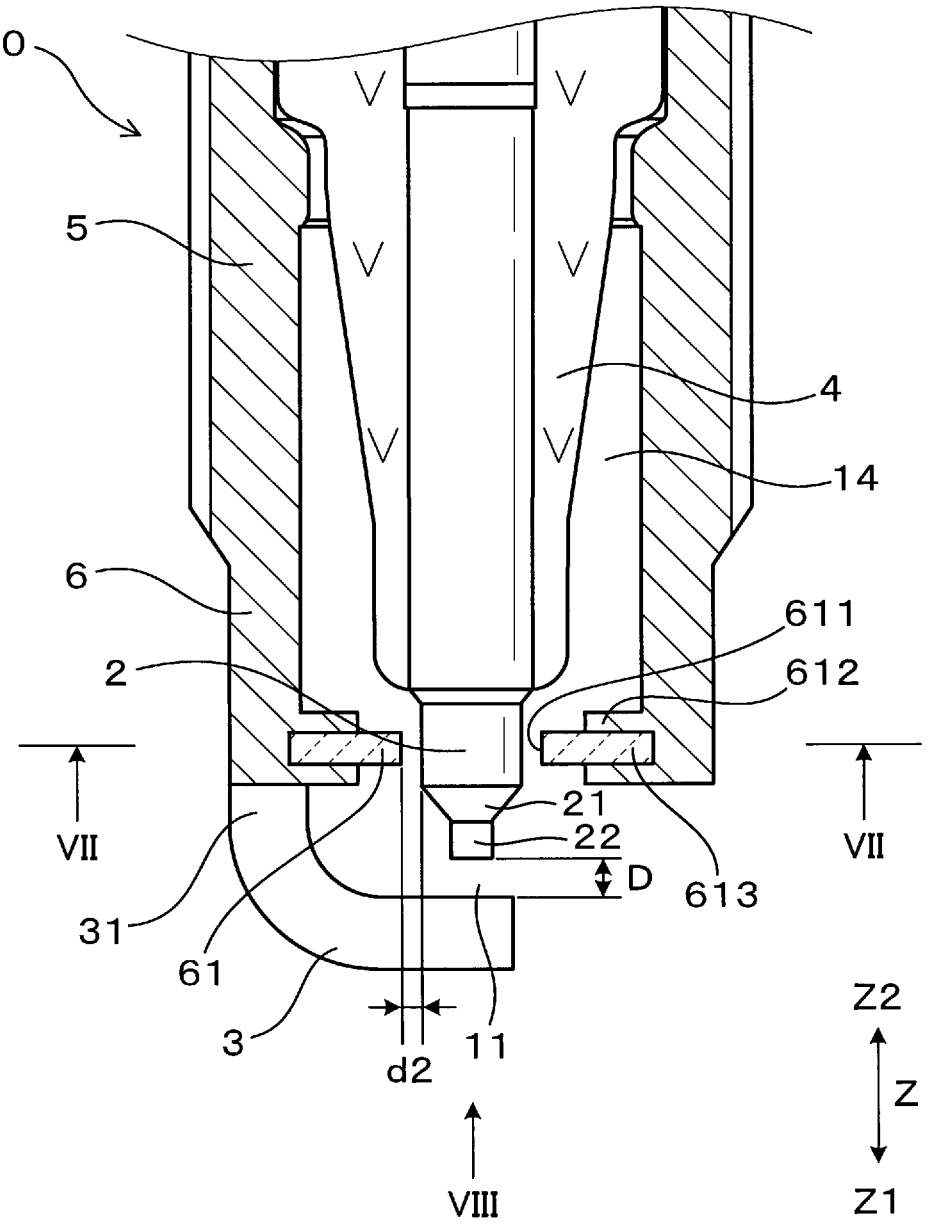
FIG. 6 is a cross-sectional view of a portion of the ignition apparatus on the distal end side according to a third embodiment.
Figure 7:
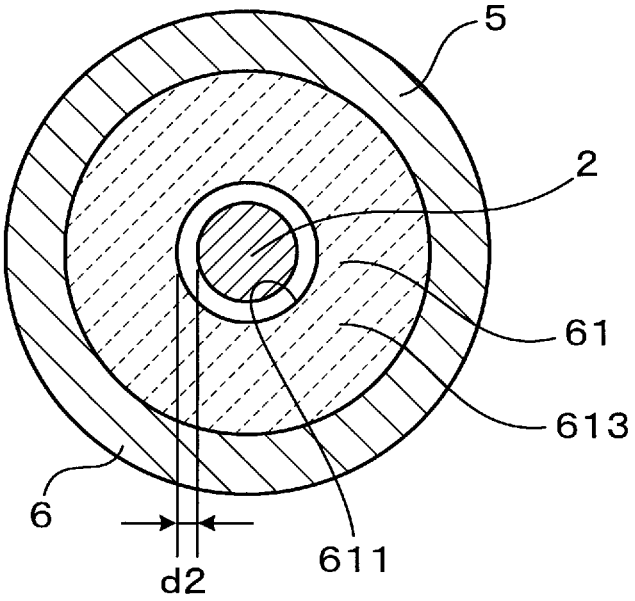
FIG. 7 is a cross-sectional view taken along line VII-VII in FIG. 6.
Figure 8:
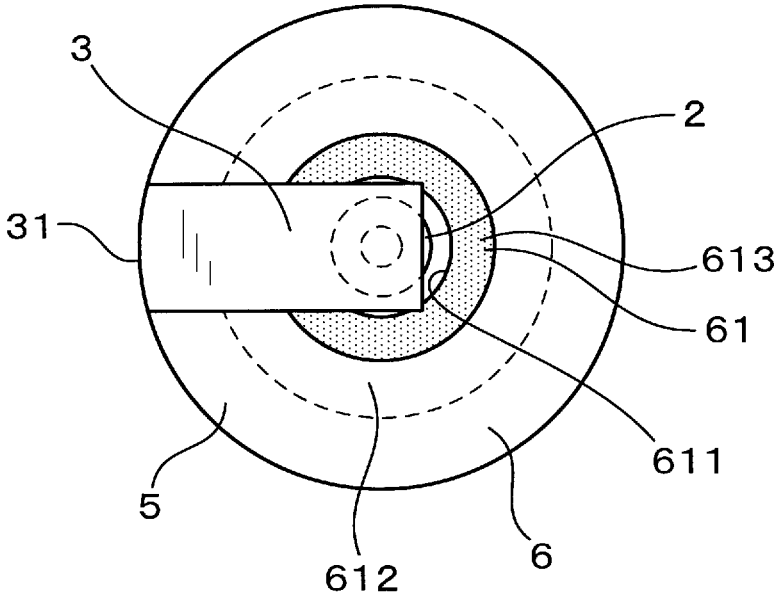
FIG. 8 is a plan view viewed from arrow VIII in FIG. 6.

According to a third embodiment, as shown in FIG. 6 to FIG. 8, the inward protruding portion 61 has an opposing insulating portion 613 in a portion opposing the center electrode 2. The opposing insulating portion 613 includes an insulating material.

For example, the opposing insulating portion 613 can include a ceramic such as alumina.

An outer circumferential portion of the opposing insulating portion 613 is held by the insulator protective wall portion 6 that includes a metal. In addition, a protruding metal portion 612 that configures a portion of the inward protruding portion 61 is provided in the distal end portion of the insulator protective wall portion 6. The protruding metal portion 612 protrudes inward from the insulator protective wall portion 6. However, an inner-side end surface of the protruding metal portion 612 is more radially outside than the inner-side end surface of the opposing insulating portion 613. That is, the inner-side end surface 611 of the inward protruding portion 61 is configured by the inner-side end surface of the opposing insulating portion 613.

As shown in FIG. 7 and FIG. 8, according to the present embodiment as well, the inward protruding portion 61 is formed to surround the outer circumference of the center electrode 2. In addition, the opposing insulating portion 613 is also formed to surround the outer circumference of the center electrode 2. The opposing insulating portion 613 is configured by a circular ring-shaped insulating member. In addition, the opposing insulating portion 613 is held in the protruding metal portion 612 such that a portion of the circular ring-shaped member on the inner circumferential side is exposed towards the inner side from the circular ring-shaped protruding metal portion 612.

A distance d2 between the inward protruding portion 61 and the center electrode 2 is equal to or less than the dimension D of the discharge gap 11. In particular, according to the present embodiment, the distance d2 is less than the dimension D of the discharge gap 11.

Other configurations are similar to those according to the first embodiment. Here, of the reference numbers that are used according to the second and subsequent embodiments, the reference numbers that are the same as those used in a previous embodiment indicate constituent elements and the like that are similar to those according to the previous embodiment, unless otherwise noted.

According to the present embodiment, the inward protruding portion 61 includes the opposing insulating portion 613. Therefore, the occurrence of discharge between the inward protruding portion 61 and the center electrode 2 can be prevented. As a result, discharge in the discharge gap 11 can be easily ensured. In accompaniment, the space between the inward protruding portion 61 and the center electrode 2 can be decreased. That is, as shown in FIG. 6, the distance d2 can be easily shortened. As a result, infiltration of fuel or soot from the distal end side Z1 into the inner side (that is, the pocket portion 14) of the housing 5 can be more effectively prevented.

In addition, as a result of the distance d2 being set to be equal to or less than the dimension D of the discharge gap 11, the above-described effects can be easily achieved. In particular, according to the present embodiment, the distance d2 is less than the dimension D. Therefore, infiltration of fuel or soot into the inner side of the housing 5 can be easily prevented. Smoldering can be even more reliably prevented.

Other working effects are similar to those according to the first embodiment.

Here, as a variation example according to the present embodiment, a configuration in which the distance d2 is 0, that is, the inner-side end surface of the opposing insulating portion 613 is in contact with the outer circumferential surface of the center electrode 2 is also possible. In this case, infiltration of fuel from the distal end side Z1 into the inner side of the housing 5 can be even more reliably prevented.

Furthermore, as another variation example according to the present embodiment, the distance d2 can be greater than the dimension D. For example, in cases in which the dimension D of the discharge gap 11 is particularly small, the distance d2 may be set to be greater than the dimension D.

Fourth Embodiment

Figure 9:
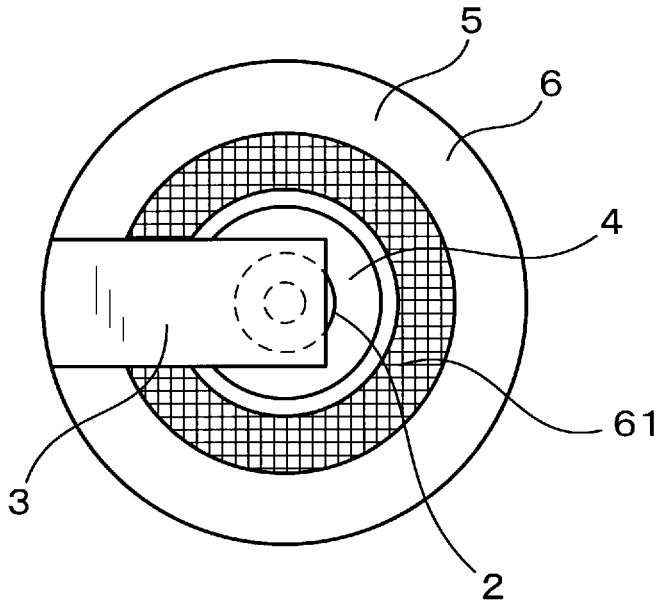
FIG. 9 is a plan view of the spark plug according to a fourth embodiment, viewed from the distal end side.
Figure 10:
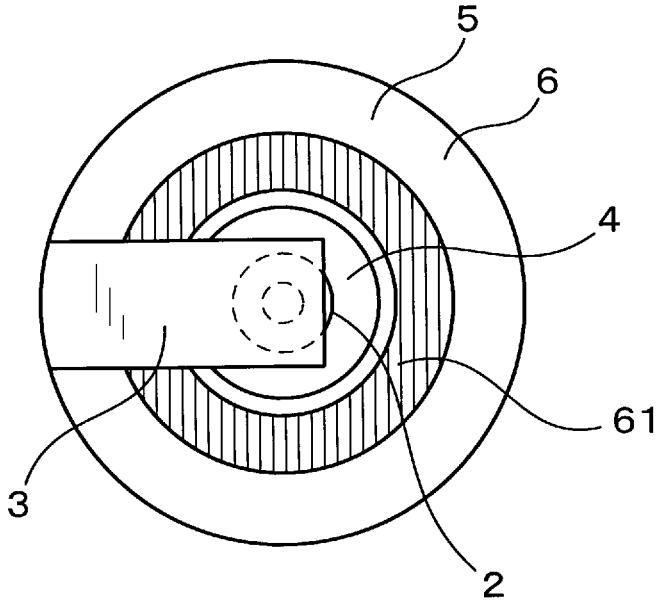
FIG. 10 is a plan view of another spark plug according to the fourth embodiment, viewed from the distal end side.

According to a fourth embodiment, as shown in FIG. 9 and FIG. 10, the inward protruding portion 61 is configured by a member that has air permeability in a thickness direction.

In other words, the inward protruding portion 61 has air permeability in the thickness direction, that is, the axial direction Z of the spark plug 10. For example, as shown in FIG. 9, the inward protruding portion 61 can be formed by a circular ring-shaped member that is formed to have a grid-like structure. Alternatively, for example, as shown in FIG. 10, the inward protruding portion 61 may be formed by a circular ring-shaped member through which numerous slits pass.

Here, the size of the grid or the width of the slits in the inward protruding portion 61 is made small enough that liquid fuel, soot, and the like are prevented from passing. Meanwhile, the size of the grid or the width of the slit is made large enough that gas, such as air, can smoothly pass.

In addition, according to the present embodiment, the inward protruding portion 61 may be formed by an insulating member or a metal member.

Other configurations are similar to those according to the first embodiment.

According to the present embodiment, ventilation of the pocket portion 14 is facilitated. In addition, infiltration of fuel and soot into the pocket portion 14 can be effectively inhibited. That is, infiltration of fuel and soot can be inhibited even though the inward protruding portion 61 has air permeability. In other words, if the size of the grid, the width of the slits, or the like are made sufficiently small, as described above, liquid fuel and soot can be prevented from passing through the grid or the slits. As a result, the pocket portion 14 can be easily ventilated while preventing the infiltration of fuel and soot into the pocket portion 14. Consequently, the ignition apparatus 1 that has excellent ignitability can be achieved.

Other working effects are similar to those according to the first embodiment.

Fifth Embodiment

Figure 11:
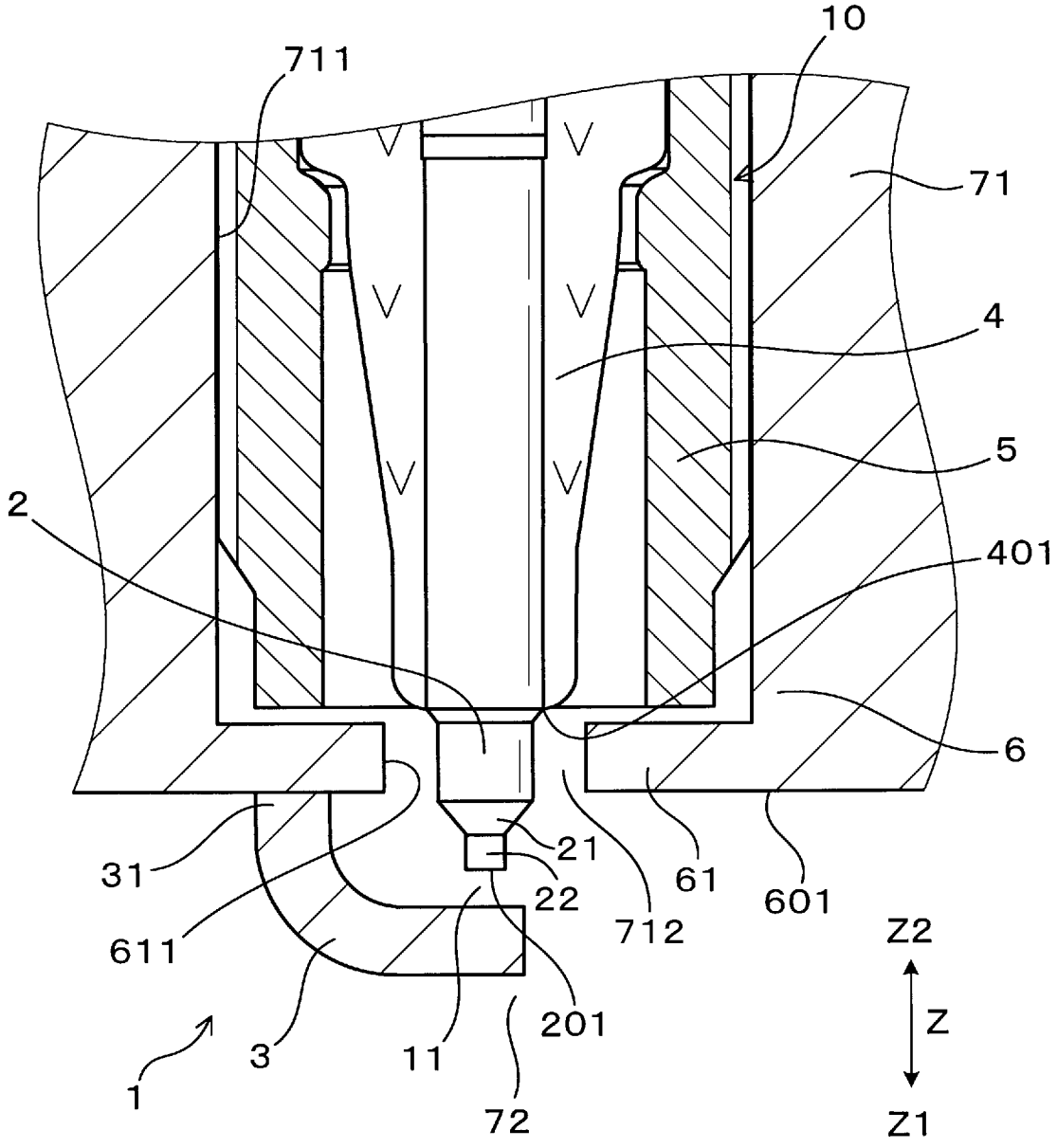
FIG. 11 is a cross-sectional view of the ignition apparatus according to a fifth embodiment.

According to a fifth embodiment, as shown in FIG. 11, the ignition apparatus 1 is configured such that the inward protruding portion 61 and the ground electrode 3 are attached to the cylinder head 71.

That is, according to the present embodiment, neither the inward protruding portion 61 nor the ground electrode 3 is formed in the spark plug 10.

In addition, according to the present embodiment, the insulator protective wall portion 6 is also configured by a portion of the cylinder head 71. That is, the distal end 601 of the insulator protective wall portion 6 is positioned further towards the distal end side Z1 than the distal end 401 of the insulator is and further towards the proximal end side Z2 than the distal end 201 of the center electrode 2 is. A configuration that meets this state is a portion of the cylinder head 71 that surrounds the periphery of the distal end portion of the insulator 4 from the outer side in the radial direction.

In addition, the inward protruding portion 61 is formed from the insulator protective wall portion 6 configured by a portion of the cylinder head 71 towards the center electrode 2. As described above, the inward protruding portion 61 is also a portion of the cylinder head 71. According to the present embodiment, a small opening portion 712 of which an inner diameter is smaller than an inner circumferential contour of the housing 5 is formed in a distal end portion of the plug hole 711 that is formed in the cylinder head 71.

An inner circumferential surface of the small opening portion 712 serves as the inner-side end surface 611 of the inward protruding portion 611 and opposes the center electrode 2 in the radial direction. A shape of the small opening portion 712 when viewed in the axial direction Z is a circle.

In addition, the ground electrode 3 is configured such that the fixed end 31 is joined to a distal end surface of the cylinder head 71. Furthermore, the ground electrode 3 protrudes from the distal end surface (that is, an inner wall surface of the combustion chamber 72) of the cylinder head 71 towards the distal end side Z1, and bends towards the small opening portion 712. The periphery of the end portion of the ground electrode 3 on the side opposite the fixed end 31 opposes the center electrode 2 from the axial direction Z. As a result, the discharge gap 11 is formed between the ground electrode 3 and the center electrode 2.

Other configurations are similar to those according to the first embodiment.

According to the present embodiment, the insulator protective wall portion 6 that includes the inward protruding portion 61 is not required to be provided. Therefore, manufacturing cost of the spark plug 10 can be reduced.

Other working effects are similar to those according to the first embodiment.

Sixth Embodiment

Figure 12:
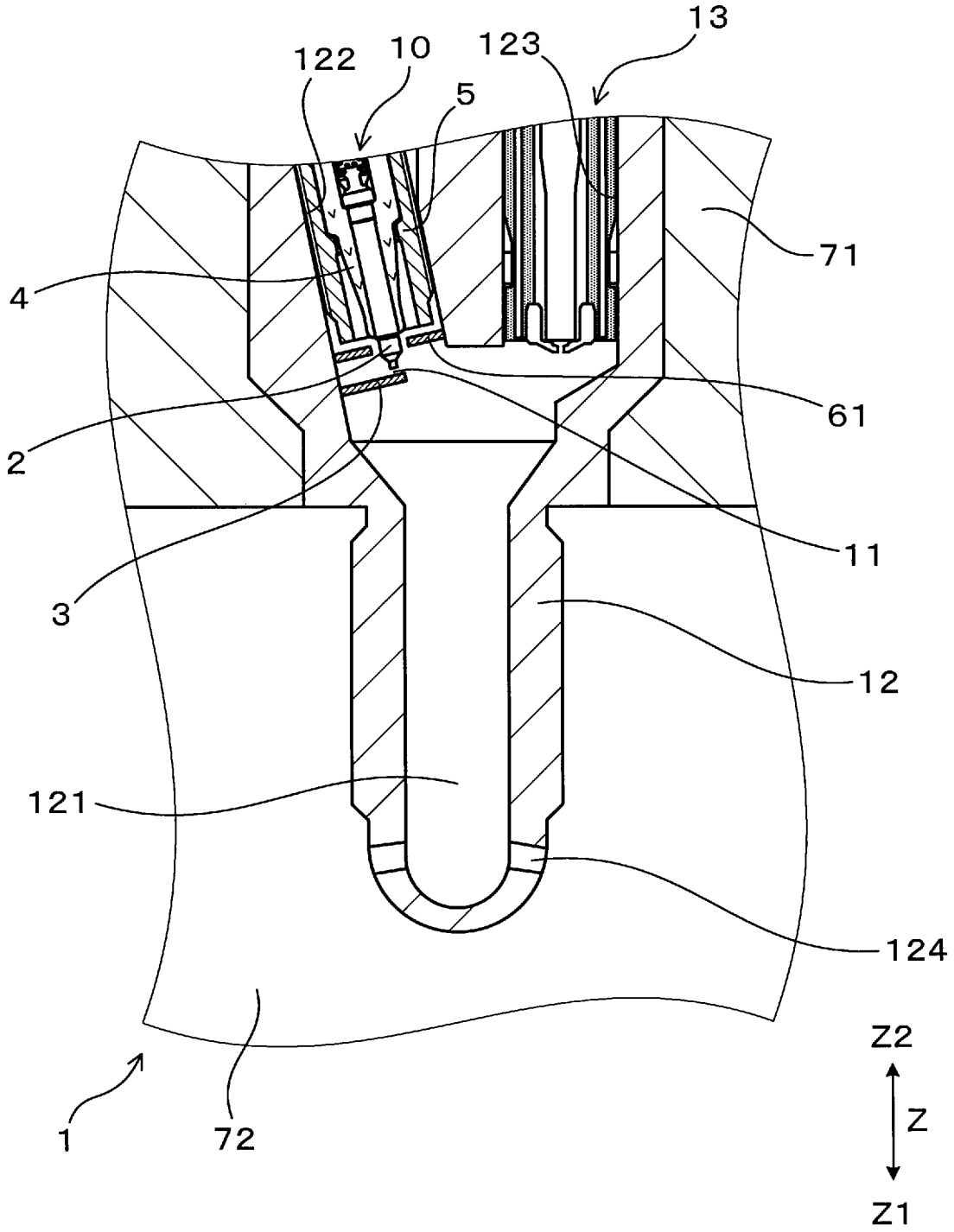
FIG. 12 is a cross-sectional view of the ignition apparatus according to a sixth embodiment.

According to a sixth embodiment, as shown in FIG. 12, the ignition apparatus 1 includes an auxiliary chamber formation body 12.

That is, the auxiliary chamber formation body 12 includes an auxiliary chamber 121 on an inner side of the auxiliary chamber formation body 12. In addition, the auxiliary chamber formation body 12 includes a plug holding portion 122 and an injection valve holding portion 123 on the proximal end side Z2 of the auxiliary chamber 121. The auxiliary chamber 121 protrudes into the combustion chamber 72 in a state in which the auxiliary chamber formation body 12 is fixed to the cylinder head 71.

The auxiliary chamber 121 and the combustion chamber 72 are partitioned by the auxiliary chamber formation body 12. A nozzle hole 124 that opens into the combustion chamber 72 from the auxiliary chamber 121 is formed in the auxiliary chamber formation body 12.

The spark plug 10 is attached to the plug holding portion 122 of the auxiliary chamber formation body 12. In addition, a fuel injection valve 13 is attached to the injection valve holding portion 123 of the auxiliary chamber formation body 12. The auxiliary chamber 121 communicates between the plug holding portion 122 and the injection valve holding portion 123.

In the ignition apparatus 1 according to the present embodiment, fuel that is injected from the fuel injection valve 13 mixes with air inside the auxiliary chamber 121. A high-concentration air-fuel mixture is formed. The air-fuel mixture is then ignited by discharge from the spark plug 10. As a result, a flame is formed inside the auxiliary chamber 121. In addition, the flame is injected into the combustion chamber 72 from the nozzle hole 124. Consequently, combustion occurs in the combustion chamber 72.

According to the present embodiment, in the ignition apparatus 1 configured as described above, the inward protruding portion 61 and the ground electrode 3 are provided in a portion of the auxiliary chamber formation body 12. In addition, a portion of the auxiliary chamber formation body 12 serves as the insulator protective wall portion 6. That is, a portion of the auxiliary chamber formation body 12 that is formed to surround the periphery of the distal end portion of the insulator 4 from the outer circumferential side serves as the insulator protective wall portion 6. In addition, the circular ring-shaped inward protruding portion 61 is attached to protrude towards the center electrode 2 from the periphery of the distal end portion of the plug holding portion 122.

Furthermore, the ground electrode 3 is formed further towards the distal end side Z1 than the inward protruding portion 61, so as to protrude towards the inner side of the auxiliary chamber 121. The ground electrode 3 protrudes from an inner-side wall surface of the auxiliary chamber formation body 12 in an approximately straight manner. The protruding end of the ground electrode 3 opposes the center electrode 2 from the distal end side Z1. As a result, the discharge gap 11 is formed between the ground electrode 3 and the center electrode 2.

Other configurations are similar to those according to the first embodiment.

According to the present embodiment, a spray of fuel that is injected into the auxiliary chamber 121 from the fuel injection valve 13 is more easily present near the distal end portion of the spark plug 10 that is set inside the auxiliary chamber formation body 12. However, as a result of the inward protruding portion 61 being formed, the fuel can be prevented from infiltrating the periphery of the insulator 4 of the spark plug 10. In addition, soot that is produced as a result of unevaporated fuel being burned inside the auxiliary chamber 121 reaching the insulator 4 can be suppressed.

Other working effects are similar to those according to the first embodiment.

The present disclosure is not limited to the above-described embodiments. Various embodiments are applicable without departing from the spirit of the present disclosure.

What is claimed is:

1. An ignition apparatus for an internal combustion engine, the ignition apparatus comprising:

a center electrode;

a ground electrode that is disposed such that a discharge gap is provided between the ground electrode and the center electrode;

an insulator that holds the center electrode on an inner side of the insulator;

a housing that holds the insulator on an inner side of the housing; and an insulator protective wall portion that is arranged to surround an outer circumferential side of a distal end portion of the insulator, wherein a distal end of the insulator protective wall portion is positioned further towards a distal end side than a distal end of the insulator is and further towards a proximal end side than a distal end of the center electrode is, and the insulator protective wall portion includes an inward protruding portion that protrudes towards a side surface of the center electrode.

2. The ignition apparatus for an internal combustion engine according to claim 1, wherein:

the inward protruding portion is formed to surround an outer circumference of the center electrode.

3. The ignition apparatus for an internal combustion engine according to claim 1, wherein:

the inward protruding portion comprises a metal; and a distance between the inward protruding portion and the center electrode is greater than a dimension of the discharge gap.

4. The ignition apparatus for an internal combustion engine according to claim 2, wherein:

the inward protruding portion comprises a metal; and a distance between the inward protruding portion and the center electrode is greater than a dimension of the discharge gap.

5. The ignition apparatus for an internal combustion engine according to claim 1, wherein:

the inward protruding portion includes an opposing insulating portion that comprises an insulating material in a portion opposing the center electrode.

6. The ignition apparatus for an internal combustion engine according to claim 2, wherein:

the inward protruding portion includes an opposing insulating portion that comprises an insulating material in a portion opposing the center electrode.

7. The ignition apparatus for an internal combustion engine according to claim 5, wherein:

a distance between the inward protruding portion and the center electrode is equal to or less than a dimension of the discharge gap.

8. The ignition apparatus for an internal combustion engine according to claim 6, wherein:

a distance between the inward protruding portion and the center electrode is equal to or less than a dimension of the discharge gap.

9. The ignition apparatus for an internal combustion engine according to claim 1, wherein:

the insulator protective wall portion is formed in a distal end portion of the housing.

10. The ignition apparatus for an internal combustion engine according to claim 9, wherein:

the ground electrode is fixed to the housing.

* * * * *